US005823431A

United States Patent [19]

Pierce

[11] Patent Number: 5,823,431

[45] Date of Patent: Oct. 20, 1998

[54] ILLUMINATED LAWN SPRINKLER

[76] Inventor: Adam B. Pierce, 44 Arrandale Ave., Great Neck, N.Y. 11024

[21] Appl. No.: 696,044

[22] Filed: Aug. 13, 1996

[51] Int. Cl.[6] ..... F21P 7/00

[52] U.S. Cl. ..... 239/19; 362/96

[58] Field of Search ..... 239/17–19, 273; 362/96

[56] References Cited

U.S. PATENT DOCUMENTS

| | | | |
|---|---|---|---|
| D. 182,605 | 4/1958 | Litchfield | 239/19 X |
| 1,982,315 | 11/1934 | Lundberg | 239/19 |
| 2,593,517 | 4/1952 | Angulo | 239/19 |
| 2,877,052 | 3/1959 | Scholl | 239/19 |
| 2,883,114 | 4/1959 | Horvath | 239/19 |
| 3,104,815 | 9/1963 | Schultz | 239/19 |
| 3,162,367 | 12/1964 | Nowack | 239/19 |
| 3,337,134 | 8/1967 | Bond | 239/19 |
| 3,894,689 | 7/1975 | Billingsley | 239/18 |
| 4,088,880 | 5/1978 | Walsh | 239/18 X |

*Primary Examiner*—Lesley D. Morris

[57] ABSTRACT

A new Illuminated Lawn Sprinkler for which provides an aesthetically pleasing display of light and color through illuminated water patterns. The inventive device includes lighting fixture with removable lens, water sensor means which controls the battery operated water source.

3 Claims, 3 Drawing Sheets

FIG. 3
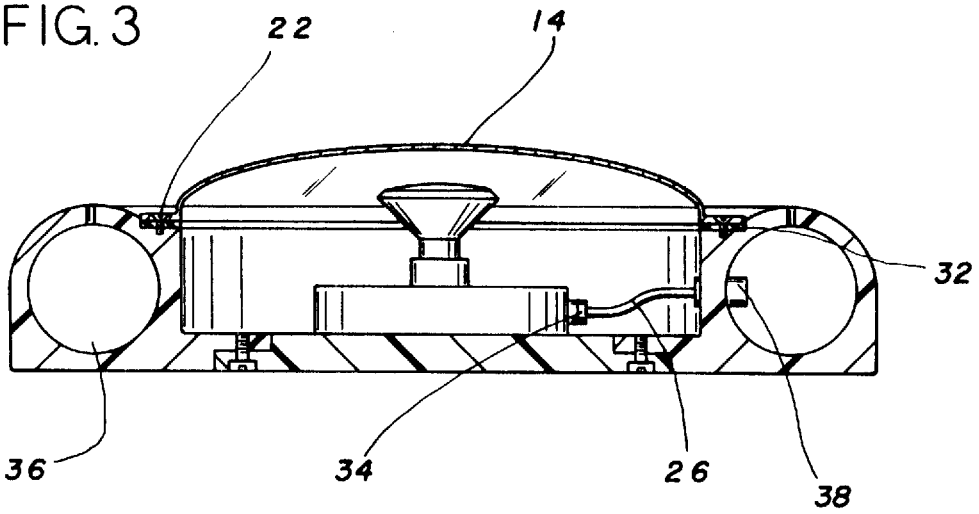
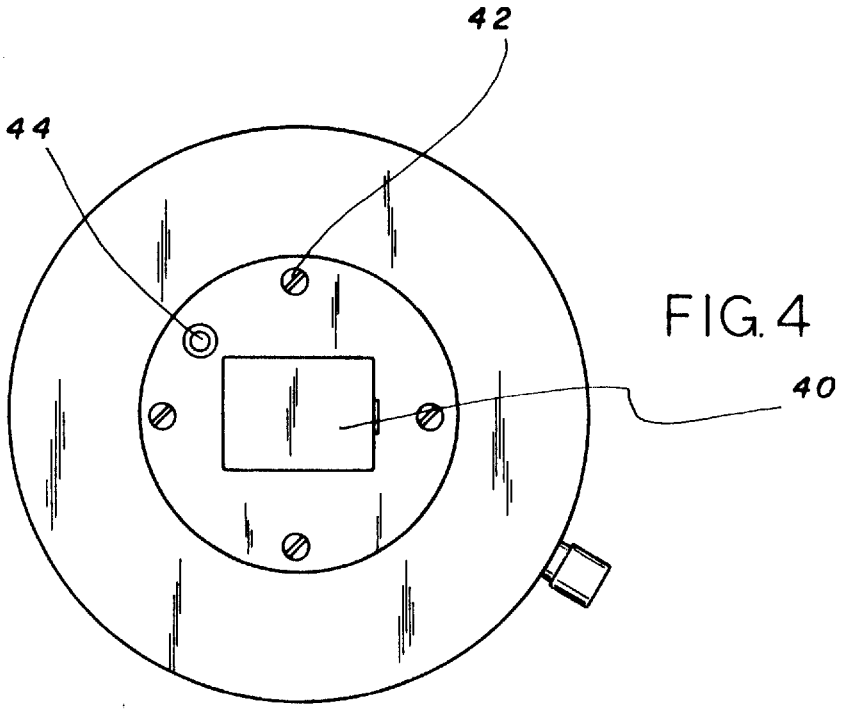
FIG. 4

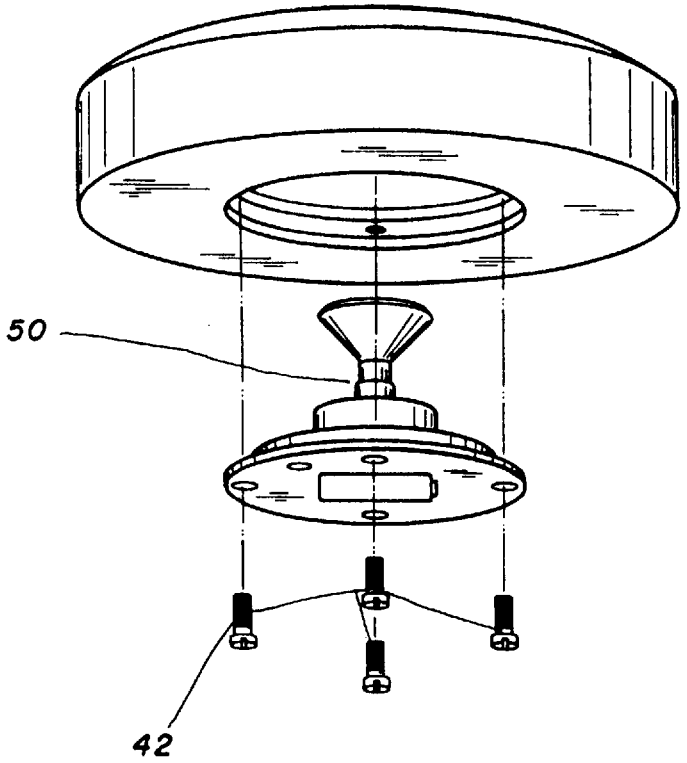
FIG. 5
FIG. 6
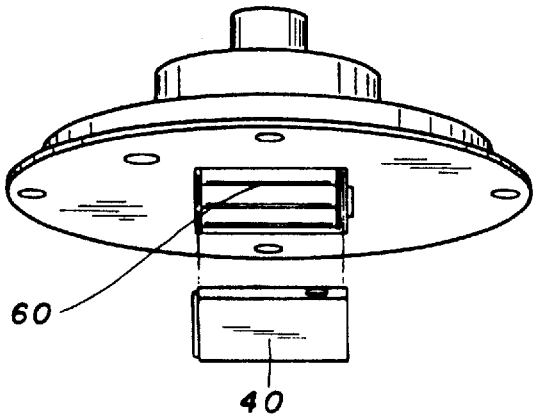

ILLUMINATED LAWN SPRINKLER

BACKGROUND OF THE INVENTION

1. Field of the Invention

The present invention relates to an adjustable sprinkler system which displays light and color and more particularly pertains to a new Illuminated Lawn Sprinkler which provides an aesthetically pleasing display of light and color through illuminated water patterns.

2. Description of the Prior Art

The use of adjustable sprinkler system which displays light and color is known in the prior art. More specifically, adjustable sprinkler system which displays light and color heretofore devised and utilized are known to consist basically of familiar, expected and obvious structural configurations, notwithstanding the myriad of designs encompassed by the crowded prior art which have been developed for the fulfillment of countless objectives and requirements.

Known prior art adjustable sprinkler system which displays light and color include U.S. Pat. No. 4,945,675; U.S. Pat. No. 4,749,126; U.S. Pat. No. 5,160,086; U.S. Pat. No. 4,984,139; U.S. Pat. No. 4,955,540 and U.S. Pat. No. 4,564,889.

While these devices fulfill their respective, particular objectives and requirements, the aforementioned patents do not disclose a new Illuminated Lawn Sprinkler. The inventive device includes lighting fixture with removable lens and water sensor means which controls the battery operated water source.

In these respects, the Illuminated Lawn Sprinkler according to the present invention substantially departs from the conventional concepts and designs of the prior art, and in so doing provides an apparatus primarily developed for the purpose of providing an aesthetically pleasing display of light and color through illuminated water patterns.

SUMMARY OF THE INVENTION

In view of the foregoing disadvantages inherent in the known types of adjustable sprinkler system which displays light and color now present in the prior art, the present invention provides a new Illuminated Lawn Sprinkler construction wherein the same can be utilized for which provides an aesthetically pleasing display of light and color through illuminated water patterns.

The general purpose of the present invention, which will be described subsequently in greater detail, is to provide a new Illuminated Lawn Sprinkler apparatus and method which has many of the advantages of the adjustable sprinkler system which displays light and color mentioned heretofore and many novel features that result in a new Illuminated Lawn Sprinkler which is not anticipated, rendered obvious, suggested, or even implied by any of the prior art adjustable sprinkler system which displays light and color, either alone or in any combination thereof.

To attain this, the present invention generally comprises lighting fixture with removable lens, water sensor means which controls the battery operated water source.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Illuminated Lawn Sprinkler apparatus and method which has many of the advantages of the adjustable sprinkler system which displays light and color mentioned heretofore and many novel features that result in a new Illuminated Lawn Sprinkler which is not anticipated, rendered obvious, suggested, or even implied by any of the prior art adjustable sprinkler system which displays light and color, either alone or in any combination thereof.

It is another object of the present invention to provide a new Illuminated Lawn Sprinkler which may be easily and efficiently manufactured and marketed.

It is a further object of the present invention to provide a new Illuminated Lawn Sprinkler which is of a durable and reliable construction.

An even further object of the present invention is to provide a new Illuminated Lawn Sprinkler which is susceptible of a low cost of manufacture with regard to both materials and labor, and which accordingly is then susceptible of low prices of sale to the consuming public, thereby making such Illuminated Lawn Sprinkler economically available to the buying public.

Still yet another object of the present invention is to provide a new Illuminated Lawn Sprinkler which provides in the apparatuses and methods of the prior art some of the advantages thereof, while simultaneously overcoming some of the disadvantages normally associated therewith.

Still another object of the present invention is to provide a new Illuminated Lawn Sprinkler for which provides an aesthetically pleasing display of light and color through illuminated water patterns.

Yet another object of the present invention is to provide a new Illuminated Lawn Sprinkler which includes lighting fixture with removable lens, water sensor means which controls the battery operated water source.

Still yet another object of the present invention is to provide a new Illuminated Lawn Sprinkler that discloses an attractive and colorful sprinkler system which has interchangeable lenses.

Even still another object of the present invention is to provide a new Illuminated Lawn Sprinkler that allows a user to have an inexpensive means of beautifying their lawn while receiving lawn maintenance.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an exploded isometric illustration of the present invention.

FIG. 4 is a rear elevation view of the invention.

FIG. 5 is an exploded view of the bottom of the sprinkler.

FIG. 6 is an exploded view of the battery container.

DESCRIPTION OF THE PREFERRED EMBODIMENT

Figure 1:
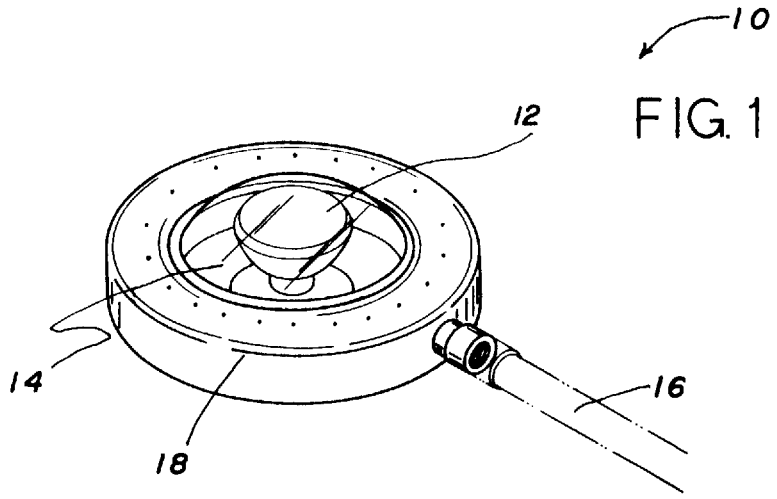
FIG. 1 is a right side perspective view of a new Illuminated Lawn Sprinkler according to the present invention.
Figure 2:
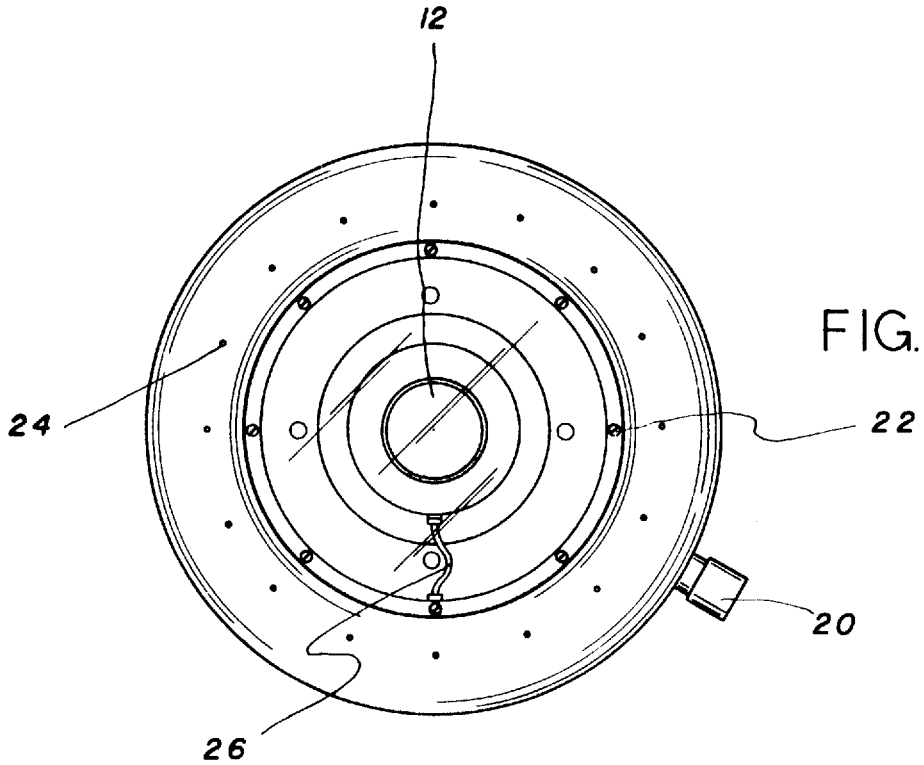
FIG. 2 is a side elevation view thereof.

With reference now to the drawings, and in particular to FIGS. 1 through 6 thereof, a new Illuminated Lawn Sprinkler embodying the principles and concepts of the present invention and generally designated by the reference numeral 10 will be described.

More specifically, it will be noted that the Illuminated Lawn Sprinkler 10 comprises a lighting fixture with removable lens and water sensor means which controls the battery operated source.

As best illustrated in FIGS. 1 through 6, it can be shown the novel aspects of the present invention.

In use, the present invention is the embodiment of an adjustable sprinkler system which displays light and color while providing lawn maintenance. The lighting fixture 50 includes a bulb 12. The fixture 50 is covered by a removable lens 14. The lens 14 can be any color. The fixture 50 is encircled by the sprinkler 18. The sprinkler 18 includes a hose 16 which is connected to the hose connecting means 20. On the surface of the sprinkler 18 are several apertures 24 from which the water is sprayed. Several upper connecting means 22 are used to hold the lens 14 in place. The sensing means 26 is used to activate the light when the water is turned on. A sealing means 32 is used to seal the upper connecting means into the lens 14. A second connecting means 34 is used to connect the sensing means 26 to the lighting fixture 50. The water flow means 36 indicates the flowing of the water in the sprinkler 18. The covering means 40 acts as a battery cover. The lighting fixture 50 is also secured at its base by the base securing means 42. A battery port 44 is available for recharging purposes of the batteries 60.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An illuminated lawn sprinkler system comprising:

a substantially annular sprinkler head having a connecting means for attaching a hose to the sprinkler head whereby water is introduced into an interior of the sprinkler head and dispersed through a plurality of apertures in the sprinkler head;

a battery powered light producing means for producing a light beam, the light producing means being attached to the sprinkler head, the light producing means further being positioned within a center of the annular sprinkler head, said light producing means including a light bulb having a portion extending above a plane in which the apertures lie;

a lens being for directing light towards water dispersed through the sprinkler head apertures, the lens being removably coupled to the sprinkler head, said lens being curved to form a domed cover over the light bulb with the light bulb extending into the domed cover to direct light upward and radially outward from the light bulb towards water released through the apertures in the sprinkler head;

a sealing means for sealing the coupling between the lens and the sprinkler head such that water dispersed through the sprinkler head is prevented from contacting the light producing means; and a water sensor means for activating the light producing means when water is introduced into the interior of the sprinkler head, the water sensing means being partially positioned within the interior of the sprinkler head through an opening in the sprinkler head, the water sensing means further being coupled to the light producing means.

2. The illuminated lawn sprinkler of claim 1, wherein the removable lens is one color chosen from a group of colors consisting of red, green, blue, yellow, pink, purple, orange, and white.

3. The illuminated lawn sprinkler of claim 1 wherein the battery providing power to the light producing means is rechargeable.

* * * * *